US006953037B2

(12) United States Patent
Rumens

(10) Patent No.: US 6,953,037 B2
(45) Date of Patent: Oct. 11, 2005

(54) DIRECT VENT FIREPLACE INSTALLATION

(75) Inventor: Kurt W. F. Rumens, Kirkland, WA (US)

(73) Assignee: Travis Industries, Inc., Kirkland, WA (US)

( * ) Notice: Subject to any disclaimer, the term of this patent is extended or adjusted under 35 U.S.C. 154(b) by 0 days.

(21) Appl. No.: 10/411,780

(22) Filed: Apr. 11, 2003

(65) Prior Publication Data

US 2004/0200470 A1 Oct. 14, 2004

(51) Int. Cl.[7] ..... F24C 3/00
(52) U.S. Cl. ..... 126/512; 126/503
(58) Field of Search ..... 126/512, 503, 126/552

(56) References Cited

U.S. PATENT DOCUMENTS

| | | | | | |
|---|---|---|---|---|---|
| 283,395 | A | * | 8/1883 | Holt | 126/95 |
| 579,740 | A | * | 3/1897 | Cohen | 126/512 |
| 3,654,913 | A | | 4/1972 | Ray et al. | |
| 4,112,913 | A | | 9/1978 | Shimek et al. | |
| 4,475,531 | A | | 10/1984 | Gerhart | |
| 4,572,156 | A | | 2/1986 | Lentz | |
| 5,009,220 | A | | 4/1991 | Cornelison | |
| D385,023 | S | * | 10/1997 | Newman et al. | D23/343 |
| 5,738,084 | A | * | 4/1998 | Hussong | 126/512 |
| 5,775,408 | A | * | 7/1998 | Shimek et al. | 165/48.1 |
| 5,794,610 | A | * | 8/1998 | Facchina | 126/512 |
| 5,826,357 | A | * | 10/1998 | Hechler | 40/428 |
| 5,887,388 | A | * | 3/1999 | Hempel et al. | 52/27 |
| 5,983,890 | A | * | 11/1999 | Thomas et al. | 126/512 |
| 6,029,655 | A | | 2/2000 | Hussong et al. | |
| 6,142,143 | A | * | 11/2000 | Martin | 126/506 |
| 6,152,551 | A | | 11/2000 | Annas | |
| 6,269,809 | B1 | | 8/2001 | Fleming | |
| 6,439,226 | B1 | | 8/2002 | Johnson et al. | |
| 6,601,579 | B2 | | 8/2003 | Fier et al. | |
| 2002/0170215 | A1 | | 11/2002 | Mix | |

FOREIGN PATENT DOCUMENTS

| | | |
|---|---|---|
| DE | 201 05 006 U | 6/2001 |
| EP | 1 233 237 | 8/2002 |
| EP | 1 275 903 | 1/2003 |
| GB | P 00034 A | of 1914 |
| GB | 318 723 | 9/1929 |
| GB | 450 149 | 7/1936 |
| GB | 669 309 | 4/1952 |
| GB | 2 180 927 | 4/1987 |
| GB | 0 611 921 | 8/1994 |
| GB | 2 298 073 | 8/1996 |
| GB | 1 199 524 | 4/2002 |
| GB | 2 372 807 | 9/2002 |

* cited by examiner

*Primary Examiner*—Alfred Basichas
(74) *Attorney, Agent, or Firm*—Perkins Coie LLP

(57) ABSTRACT

A direct vent fireplace installation assembly is provided that includes a furniture unit having an enlarged receptacle well above the ground, and a direct vent fireplace unit positioned in the receptacle of the furniture unit. The fireplace unit has a firebox contained in an outer housing, a burner assembly in the firebox, and a contoured surround positioned in and spaced apart from walls of the firebox. A chimney is coupled to the firebox. In one embodiment, the fireplace unit is mounted in a receptacle in a wall structure positioned above the floor, at approximately eye level. It is emphasized that this abstract is provided to comply with the rules requiring an abstract. It is submitted with the understanding that it will not be used to interpret or limit the scope or meaning of the claims.

39 Claims, 6 Drawing Sheets

DIRECT VENT FIREPLACE INSTALLATION

TECHNICAL FIELD

The present invention is directed to fireplace installations, and, more particularly, direct vent fireplace units and installations.

SUMMARY

The present invention overcomes limitations of the prior art and provides additional benefits. A brief summary of some embodiments and aspects of the invention are presented. Thereafter, a detailed description of the illustrated embodiments is presented, which will permit one skilled in the relevant art to understand, make, and use aspects of the invention. One skilled in the art can obtain a full appreciation of aspects of the invention from the subsequent detailed description, read together with the figures, and from the claims, which follow the detailed description.

Under one aspect of the invention, a gas-burning fireplace installation assembly is provided that is connectable to a fuel gas source. The installation assembly includes a furniture unit having a decorative front facing portion with an upper portion and a lower portion. The upper portion has an enlarged receptacle spaced above the ground and adapted to engage a support surface. A direct vent fireplace unit is positioned in the receptacle in the furniture unit's upper portion. The fireplace unit has an outer housing, a firebox contained in the outer housing, and a burner assembly in the firebox. The burner assembly is connectable to a gas line that provides the fuel gas from the fuel gas source. A chimney is coupled to the firebox.

Under another aspect of the invention, a fireplace installation assembly is provided that includes a furniture unit having a lower cabinet portion and an upper front face portion extending from the lower cabinet portion. The upper front face portion having an enlarged receptacle therein. A direct vent fireplace unit is positioned in the receptacle in the upper front face portion of the furniture unit. The fireplace unit has an outer housing, a firebox contained in the outer housing, a burner assembly in the firebox, and a contoured surround in the firebox. The contoured surround is spaced apart from the back of the firebox and is positioned between the burner assembly and the firebox.

Under another aspect of the invention, a wall-mounted fireplace installation is provided that is coupleable to a gas source. The wall structure has an enlarged receptacle positioned above the ground (e.g., the floor), and the receptacle is remote from and not surrounded by a fireplace mantle. A direct vent fireplace unit is positioned in the receptacle in the wall structure. The fireplace unit has an outer housing, a firebox contained in the outer housing, and a burner assembly in the firebox coupleable to the gas source. A contoured surround is positioned in the firebox and extends at least partially around the burner assembly between the burner assembly and the firebox. The surround is spaced apart from the firebox to define a heat shield around the burner assembly. An exhaust flue is coupled to the firebox and extends into a portion of the wall structure.

Under another aspect of the invention, a direct vent fireplace unit is provided that is positionable in an enlarged fireplace receptacle above the ground in a furniture unit or in a wall structure not surrounded by a mantle. The fireplace unit has an outer housing and a firebox contained in the outer housing. The firebox has front, rear, and side portions. A burner assembly is positioned in the firebox between the front and rear portions and is coupleable to the gas source. A surround is positioned in the firebox at least partially around the burner assembly between the burner assembly and the rear and side portions of the firebox. The surround is spaced apart from the rear portion of the firebox to define a heat shield around the burner assembly that directs heat toward the front portion of the firebox. A decorative front face is coupled to the outer housing and generally around the front portion of the firebox. The front face has height and width dimensions, the height dimension being greater than the width dimension.

DETAILED DESCRIPTION

Gas-burning, direct vent fireplace installations in furniture units and wall structures are described in detail herein in accordance with embodiments of the present invention. In the following description, numerous specific details are discussed to provide a thorough and enabling description for embodiments of the invention. One skilled in the relevant art, however, will recognize that the invention can be practiced without one or more of the specific details. In other instances, well-known structures or operations are not shown, or are not described in detail to avoid obscuring aspects of the invention. In general, alternatives and alternate embodiments described herein are substantially similar to the previously described embodiments, and common elements are identified by the same reference numbers.

FIG. 1 is a front elevation view of a furniture-mounted fireplace installation 10 in accordance with one embodiment of the present invention. The illustrated furniture-mounted fireplace installation 10 includes a gas-burning fireplace unit 12 mounted in a furniture unit 14. The fireplace unit 12 is a self-contained, direct vent fireplace insert coupled to a fuel gas source 16. The fireplace unit 12 is configured to provide heat into the room in which the fireplace installation 10 is located when the fireplace unit is activated, while also providing very aesthetically pleasing fire framed by the furniture unit 14. The fireplace unit 12 fits seamlessly within the furniture unit 14 and provides a very attractive addition to a room or an outside area.

Figure 1A:
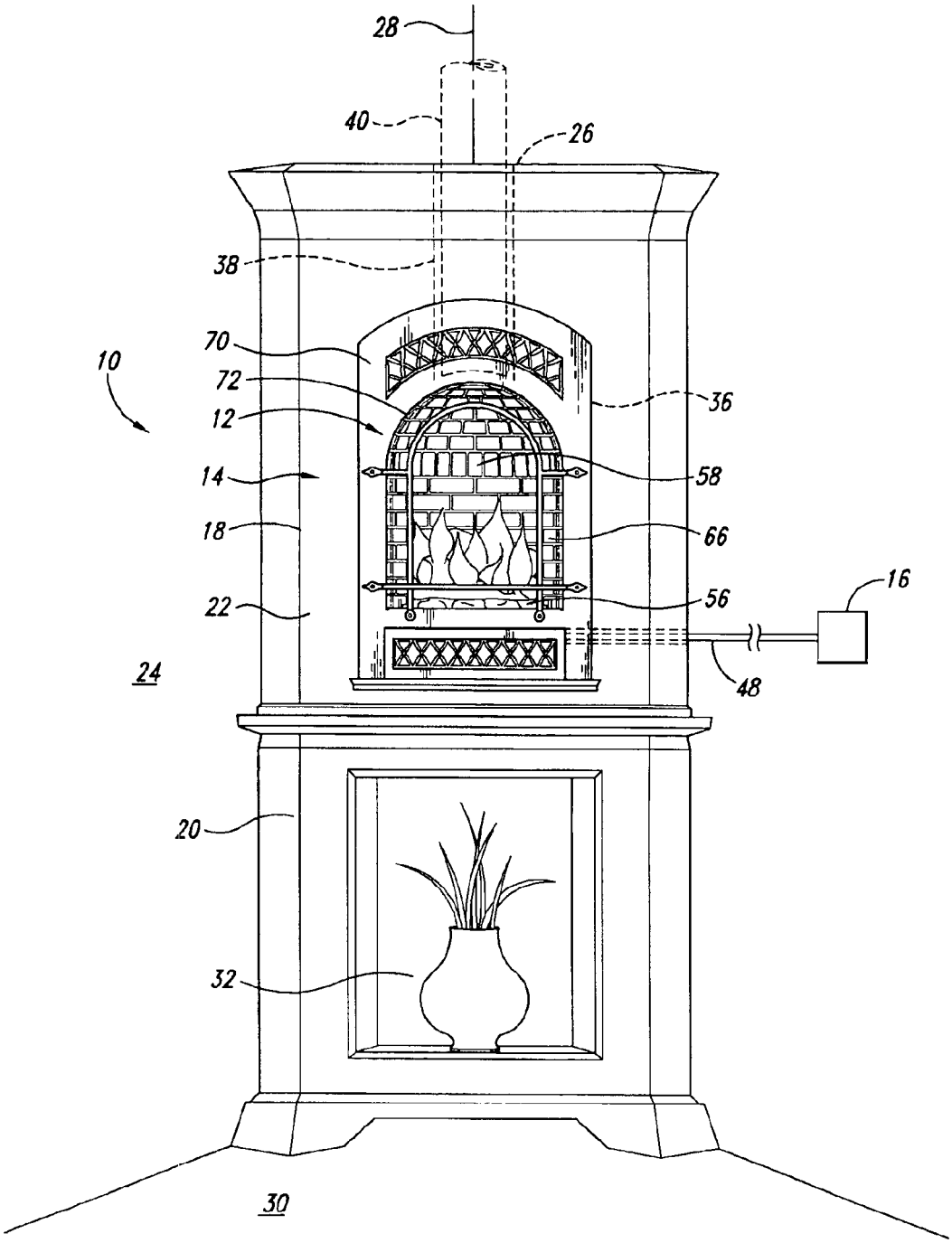
FIG. 1A is a front elevation view of a direct vent fireplace unit in a corner-mounted furniture unit in accordance with an embodiment of the invention.

The furniture unit 14 illustrated in FIG. 1A is a movable corner-mounted highboy having an upper portion 18 and a lower portion 20. The front side 22 of the furniture unit 14 faces into a room 24 or the like, and the backside 26 is shaped and sized to correspond to a corner 28 of the room 24. The furniture unit 14 is configured to support and contain the fireplace unit 12 in the upper portion 18 above the ground 30 and above the furniture unit's lower portion 20. It is to be understood that the ground 30 can be a floor, a foundation, the earth, or other support surface on which the furniture unit 14 is positioned. The lower portion 20 of the illustrated furniture unit 14 includes a display area 32 for displaying selected items, such as artwork or the like. In alternate embodiments, the display area 32 can include multiple display areas, shelves, drawers, doors, or other selected features for the decorative furniture unit 14.

Figure 1B:
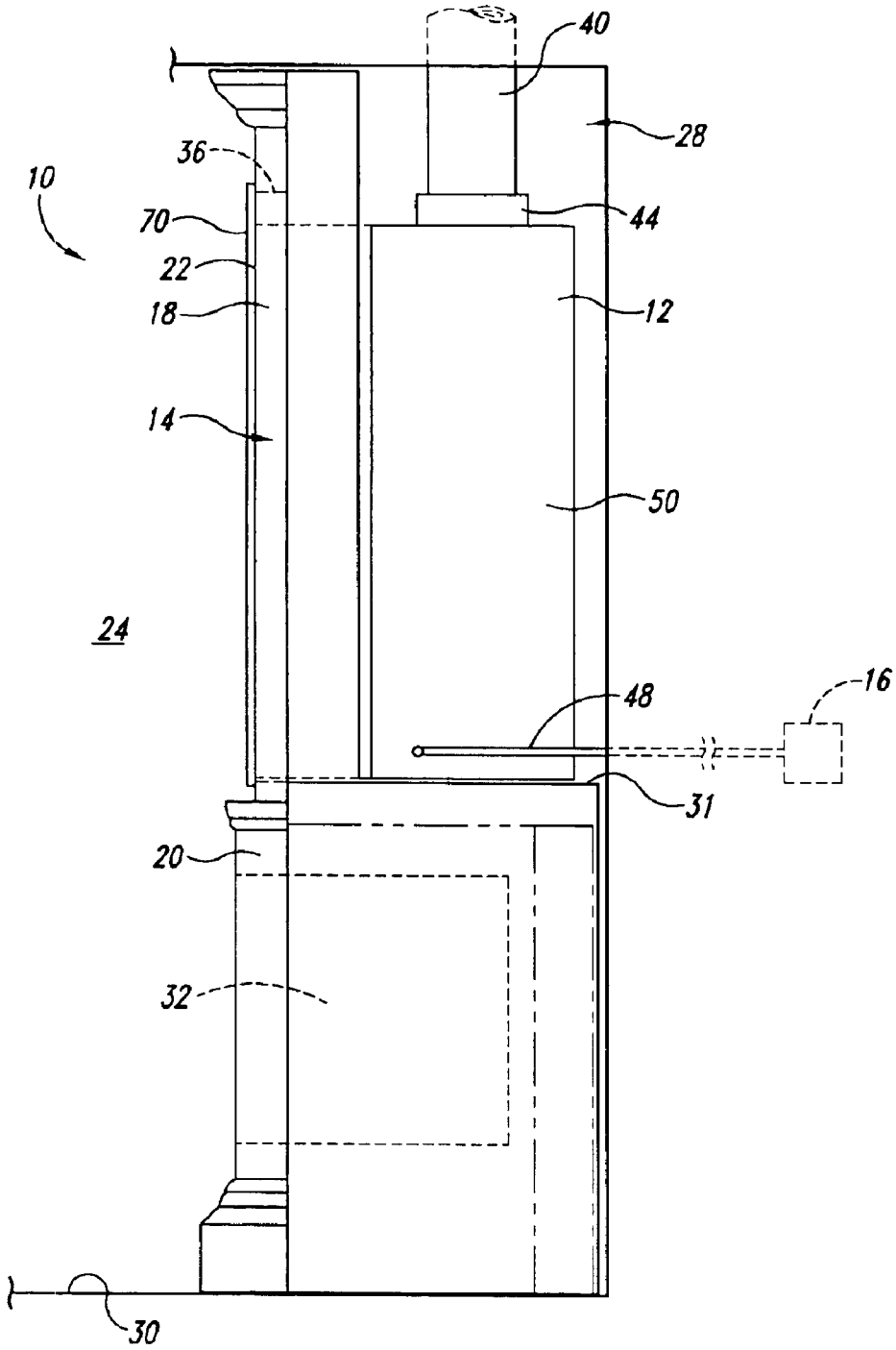
FIG. 1B is a side elevation view of one embodiment of the furniture unit and fireplace unit of FIG. 1A.

In one embodiment, the furniture unit 14 has full length side walls and a top wall that extend from the front side 22 into the corner 28. FIG. 1B is a side elevation view of an alternate embodiment of the fireplace installation of FIG. 1A. The front side 22 of the furniture unit 14 defines a front face extending along the upper and lower portions 18 and 20. The upper portion 18 has no side walls or top extending from the front side 22. Accordingly, the front side 22 along the upper portion forms a false front that receives the fireplace unit 12 therein.

The lower portion 20 of the illustrated embodiment is a cabinet-like structure with a substantially horizontal support surface 31 extending from the front side 22. The support surface 31 is positioned so a portion of the fireplace unit 12 sits on and is supported by the support surface. In one embodiment, the furniture unit's lower portion 20 can have finished side walls that support the horizontal support surface 31. In other embodiments, the lower portion 20 does not have (or need) full side walls, and the horizontal support surface can be supported by vertical legs (shown in phantom lines in FIG. 1B) or fixtures that mount to the wall.

Figure 2:
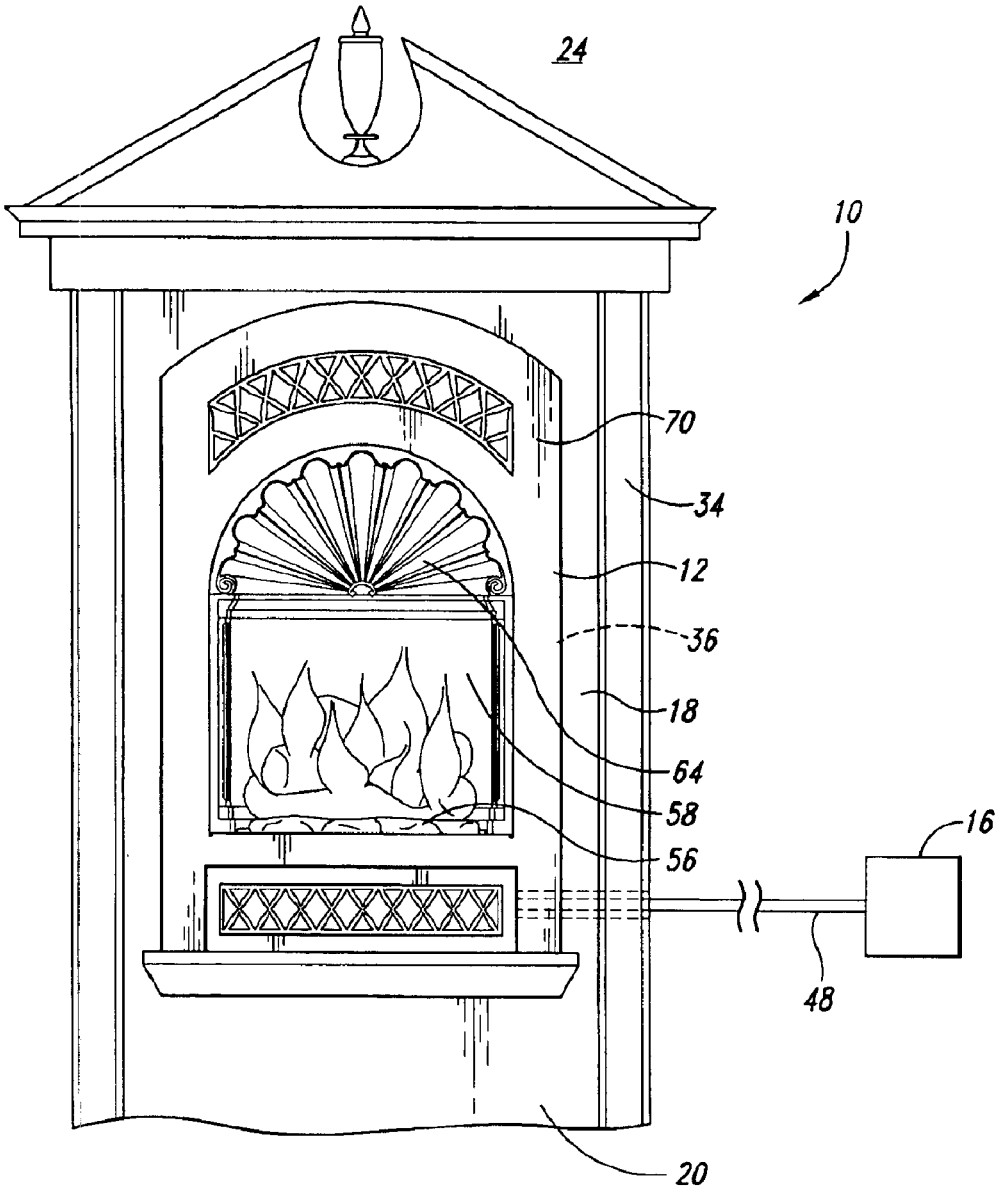
FIG. 2 is a partial front elevation view of a direct vent fireplace unit in a furniture unit in accordance with an alternate embodiment of the invention.

FIG. 2 is a partial front elevation view of a direct vent fireplace unit 12 in an alternate furniture unit 34 in accordance with an alternate embodiment of the present invention. The furniture unit 34 in the illustrated embodiment is a tall, narrow, rectangular cabinet structure configured to be positioned along a flat portion of a wall. The furniture unit 34 of FIG. 2 also has an upper portion 18 positioned above the ground (not shown) by a selected distance. The fireplace unit 12 is contained in the upper portion 18. In one embodiment, the fireplace unit 12 is positioned so the middle area of the fireplace unit is slightly below eye level of an average adult person standing in the room 24. Other embodiments can have the fireplace unit 12 at other heights above the floor.

While the furniture unit 14 of FIGS. 1A and 1B is a corner-mounted highboy-type structure, and the furniture unit 34 of FIG. 2 is a tall, narrow decorative cabinet, other embodiments can include other styles of furniture units that receive the direct vent fireplace unit 12. As an example, the furniture unit 14 can be a bookcase, an entertainment center, an armoire, a cabinet, a hutch, a dresser, a storage area, a corner-mounted unit, a generally rectangular unit, a rounded or curved display unit, or the like. The furniture unit 14 can be constructed of a variety of materials, including, but not limited to, wood, pressboard, marble, stone, cement, metal, composite materials, or the like.

Figure 3:
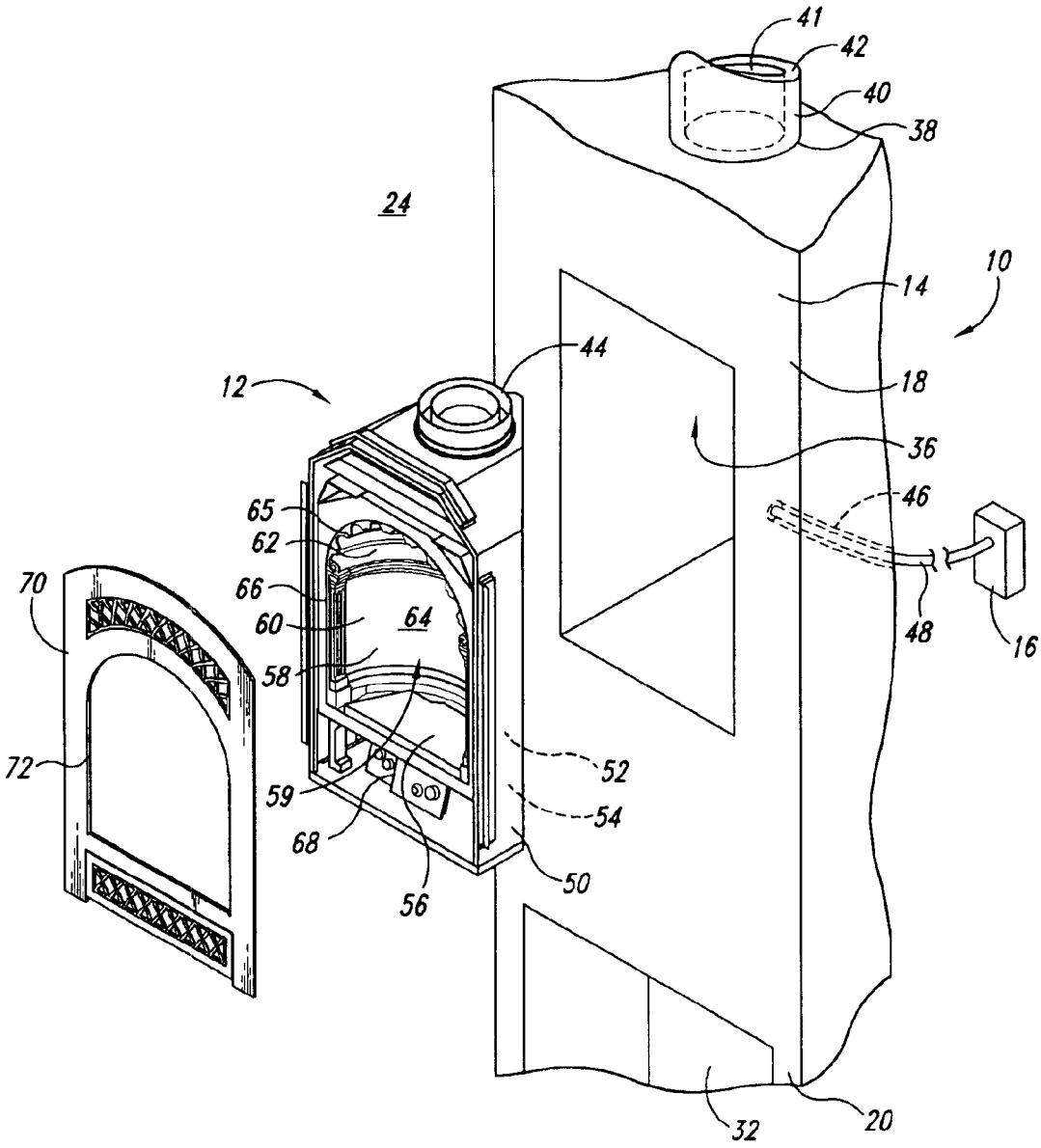
FIG. 3 is an exploded, partial front isometric view of the fireplace unit and the furniture unit of FIG. 1A.

FIG. 3 is an exploded, partial isometric view of the fireplace installation 10 of FIG. 1. The furniture unit 14 of the illustrated embodiment has an enlarged receptacle 36 in the front side 22 of the furniture unit's upper portion 18. The receptacle 36 is shaped and sized to receive and contain the fireplace unit 12, so the fireplace unit is substantially surrounded and framed by the furniture unit 14. The furniture unit 14 can include a chimney passageway 38 sized to receive a direct vent chimney 40 that extends from the fireplace unit 12. In the illustrated embodiment, the direct vent chimney 40 includes an exhaust flue 41 concentrically arranged with an air intake flue 42. The direct vent chimney 40 is sealably connected to a flue adapter 44 on the top or back of the fireplace unit 12. In an alternate embodiment, the upper portion 18 of the furniture unit 14 can be configured to allow for two separate, non-concentric flues (e.g., the exhaust flue 41 and the air intake flue 42) to be connected to the top or back of the fireplace unit 12. The chimney passageway 38 and the direct vent chimney 40 of the illustrated embodiment extend toward the top of the furniture unit 14, although alternate embodiments can have the chimney passageway and the direct vent chimney extending out the back or side of the furniture unit 14.

The furniture unit 14 can also have a fuel gas passageway 46 therein that receives a gas line 48, which carries the fuel gas from the fuel gas source 16 to the fireplace unit 12. The fuel gas passageway 46 and the gas line 48 can be routed through the furniture unit 14 in a variety of locations to provide the necessary connection to the fireplace unit 12. In the embodiment shown in FIG. 1B wherein the upper portion 18 has no sides or top, the gas line 18 connects directly to the fireplace unit 12 without having to actually extend through the furniture unit 14.

Figure 4:
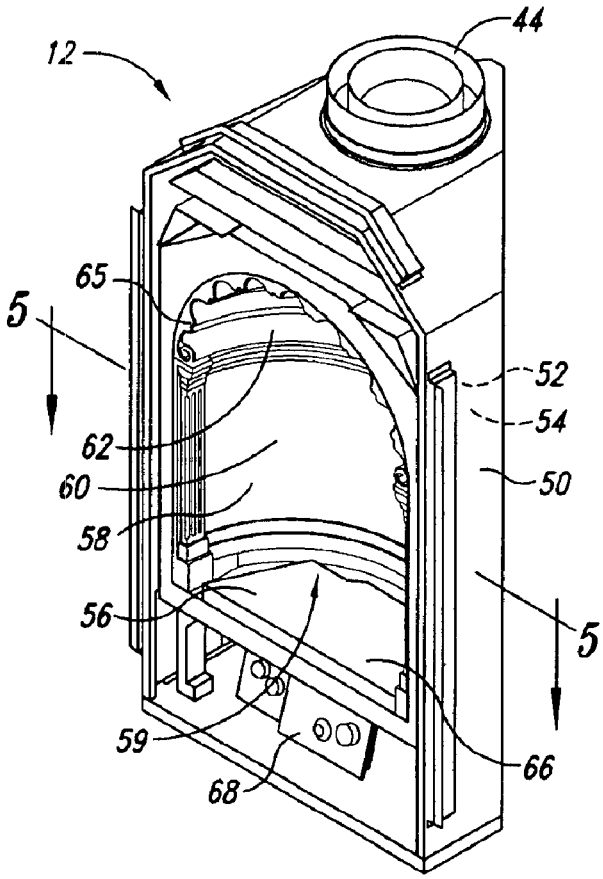
FIG. 4 is an enlarged isometric view of the direct vent fireplace unit of FIG. 1A shown removed from the furniture unit.

FIG. 4 is an enlarged isometric view of the fireplace unit 12 shown removed from the furniture unit 14 of FIGS. 1A and 1B. As best seen in FIGS. 3 and 4, the fireplace unit 12 includes a contoured outer housing 50 that fits into the receptacle 36 in the furniture unit 14 (FIG. 3). In the illustrated embodiment, the outer housing 50 is shaped with a generally triangular back portion to correspond to the corner-mounted configuration of the furniture unit 14 (FIG. 3). In alternate embodiments, the outer housing 50 can have other shapes that correspond to the desired shape relative to the furniture unit 14.

The outer housing 50 has an interior area that contains a firebox 52. The firebox 52 is spaced apart from the outer housing 50 to define heat exchange passageways 54 between the firebox and the outer housing. The heat exchange passageways 54 are adapted to direct a flow of air around the firebox 52 so a flow of air moving from the room 24 through the fireplace unit 12 is heated before the air is blown out of the fireplace unit back into the room. The fireplace unit 12 can include a blower coupled to the heat exchange passageways 54 to facilitate the flow of air through the fireplace unit.

The firebox 52 contains a burner assembly 56, such as the Ember Fyre® burner assembly manufactured by Travis Industries Inc. of Kirkland, Wash. The burner assembly 56 is a contoured burner assembly that provides a simulated coal bed, which supports simulated logs and simulates a real wood burning fire, as is seen in FIG. 1A. The firebox 52 also contains a thermally insulative, semi-dome-shaped surround 58 positioned adjacent to the burner assembly 56 so as to partially extend around the burner assembly. This heat shield at least partially shields the sides and back of the firebox from the initial heat generated by burning fuel gas at the burner assembly 56.

Figure 5:
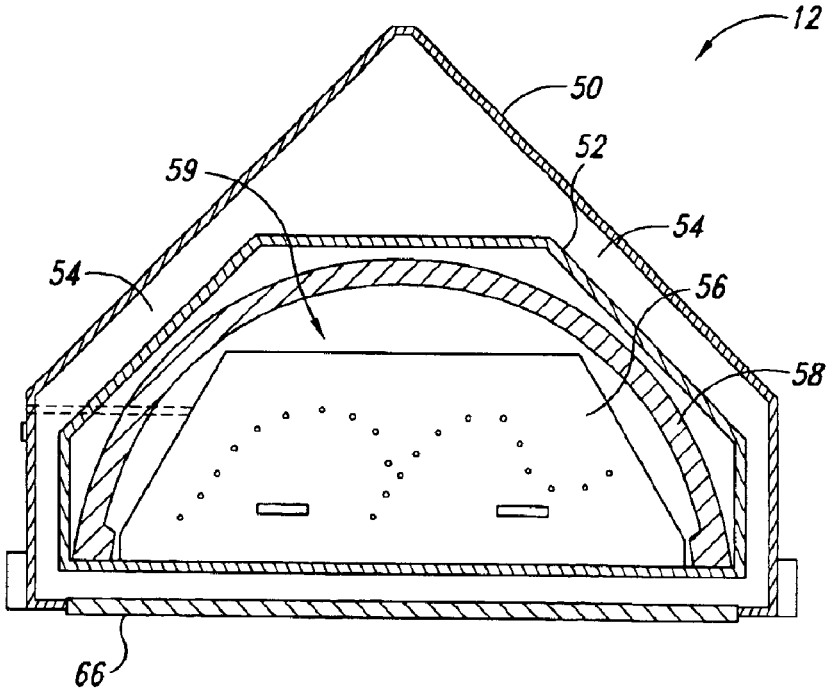
FIG. 5 is an enlarged cross-sectional view of the direct vent fireplace unit taken substantially along lines 5—5 of FIG. 4.
Figure 6:
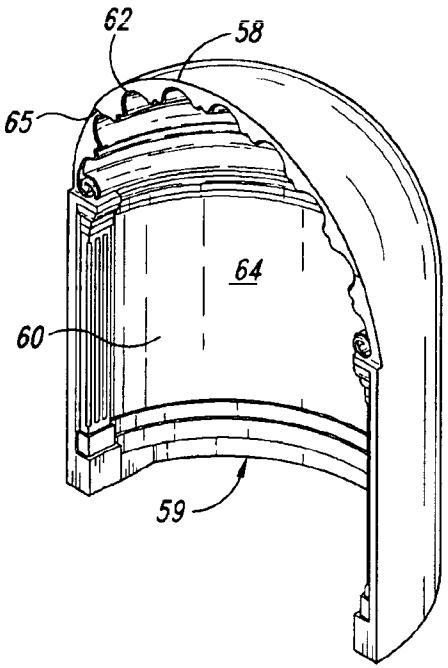
FIG. 6 is an enlarged isometric view of a contoured surround shown removed from the fireplace unit of FIG. 4.

FIG. 5 is an enlarged cross-sectional view of the fireplace unit 12 taken substantially along lines 5—5 of FIG. 4. FIG. 6 is an enlarged isometric view of the surround 58 shown removed from the fireplace unit 12 of FIG. 4. The illustrated surround 58 is a contoured, arcuate member having a semi-cylindrical body portion 60 integrally connected to a quarter-spherical top portion 62 that forms a partial dome-like top structure above the burner assembly 56. Accordingly, the contoured surround 58 defines a volume having a shape different from the shape of the interior of the firebox 52 (FIG. 5). In the illustrated embodiment, the surround 58 is self-supporting and is removably contained in the firebox 52. The surround 58 is set flush onto the bottom of the firebox 52 around the burner assembly 56 without requiring additional mounting brackets or structures to hold the surround in place. In other embodiments, the surround 58 can be fastened or otherwise secured to the firebox 52 on burner assembly 56.

The front side of the surround 58 defines an arched opening that allows for visibility from the front of the fireplace unit 12 into the surround's interior area 59 and to the burner assembly 56. The surround 58 is shaped in size so that, when a person looks into the firebox 52, a decorative interior surface 64 of the surround 58 around the burner assembly 56 is visible, but side walls and back area of the firebox are blocked from view by the surround 58. The decorative interior surface 64 has a selected pattern or shape that can be any one of a variety of decorative designs. In the illustrated embodiment, the decorative interior surface 64 has a sculpted, shell-type appearance along the quarter-spherical top portion 62, and a smooth arcuate surface on the semi-cylindrical body portion 60. Alternate embodiments can have decorative interior surfaces 64 with designs that simulate bricks, tiles, or a variety of other decorative configurations. Other alternate embodiments can have a surround 58 with a shape different from the illustrated semi-dome shape, while being self-supporting, so the surround stands up in the firebox 52 around the burner assembly 56.

In the illustrated embodiment, the surround 58 is made of a molded ceramic material capable of withstanding the significant heat generated by the burner assembly 56. In one embodiment, the surround 58 can be made of a material or composition of materials so the portions of the surround could change in color when a fire is burning in the firebox 52. Other embodiments can provide surrounds 58 made of other fire-resistant, thermally insulative materials.

As best seen in FIG. 5, the contoured surround 58 is positioned between the burner assembly 56 and the sides and back of the firebox 52. The contoured surround 58 acts as a heat shield that directs heat forwardly toward the open front portion of the firebox 52. In the illustrated embodiment, the surround 58 acts as a baffle and has integral exhaust passageways 65 along the side portions that direct the hot exhaust gases from within the area of the surround back into the upper portion of the firebox 52 and to the exhaust flue 41 of the direct vent chimney 40. Accordingly, the surround 58 substantially increases the heat efficiency of the fireplace unit 12, and helps keep the back area of the firebox 52 and the backside of the outer housing 12 at cooler temperatures. These cooler temperatures allow the fireplace unit 12 to be mounted in the receptacle 36 of the furniture unit 14 (FIG. 3) without requiring an excessive air space for safety purposes.

As best seen in FIGS. 3 and 4, the front of the firebox 52 is open to provide access into the firebox, such as for maintenance of the burner assembly 56. The open front of the firebox 52 is sealably covered by glass 66 or the like that allows for viewing into the firebox when there is a fire burning at the burner assembly 56. A plurality of conventional controls 68 are mounted in the outer housing 50 below the firebox 52 that allows a user to control the burner assembly 56 for operation of the fireplace unit 12.

As best seen in FIGS. 1A, 1B and 3, the fireplace unit 12 has a decorative fireplace frame 70 mounted to the front side of the outer housing 50 (FIG. 3) and around the receptacle 36 in the furniture unit 14. The frame 70 has an arcuate opening 72 positioned adjacent to the glass that allows a person to look into the fireplace unit 12 to see the decorative interior surface 64 of the surround 58, the burner assembly 56, and a fire burning within the firebox 52. In the illustrated embodiment, the outer housing 50, the surround 58, and the frame 70 have a "portrait" shape, wherein the height dimensions are greater than the width dimensions. As a result, the tall, thin fireplace unit 12 provides an aesthetically proportioned shape relative to the selected furniture unit 14 to provide a very handsome fireplace installation 10.

In one embodiment, the glass 66 covering the open front of the firebox 52 is conventional tempered, high temperature, nonglare glass. In another embodiment, the glass 66 has a reflective characteristic, such as a half-silvered coating, that forms a one-way mirror. Accordingly, when there is no fire within the fireplace unit 12 and the light in the room 24 (FIG. 1A) is brighter than the light in the firebox 52, the glass 66 provides a mirror-type reflection when looking at it from outside the firebox (e.g., from the room). When the burner assembly 56 is activated and a fire is started within the firebox 52, the light from within the firebox is greater than the light outside of the fireplace unit 12, so that a person can see the fire through the glass instead of seeing the reflection.

Figure 7:
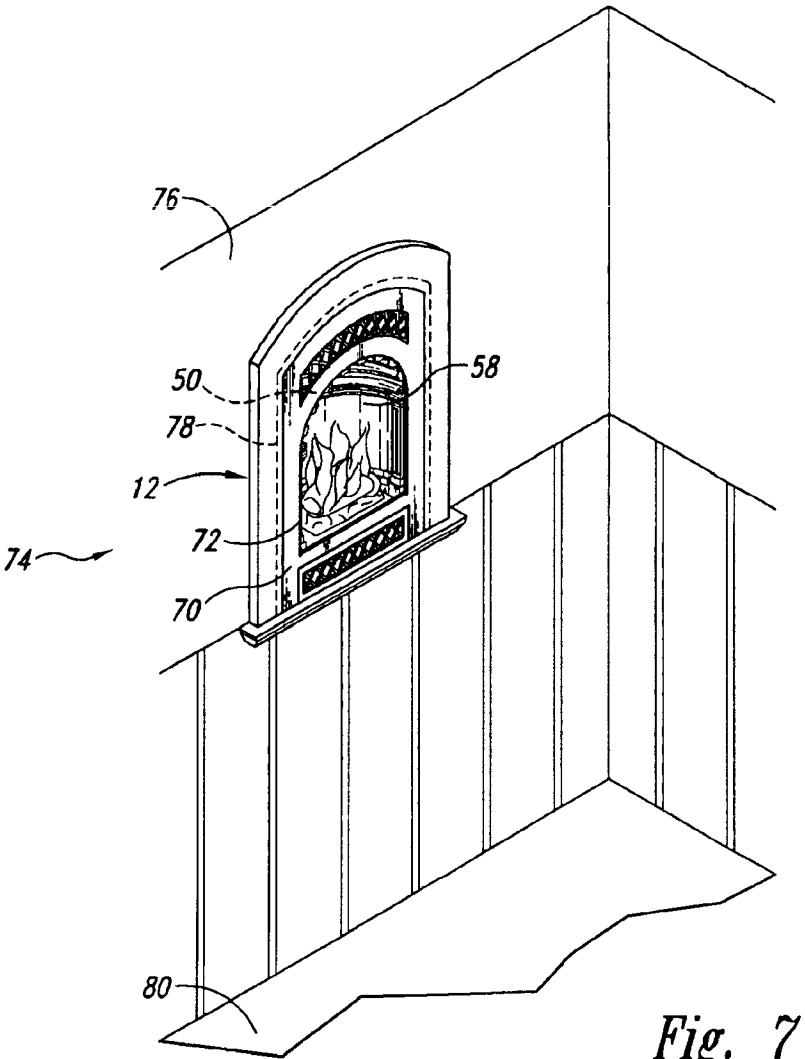
FIG. 7 is an isometric view of a wall-mounted, direct vent fireplace unit shown in a wall above the ground in accordance with an alternate embodiment of the invention.

FIG. 7 is an isometric view of a wall-mounted fireplace installation 74 in accordance with an alternate embodiment of the invention. This installation 74 includes a wall 76 having an enlarged receptacle 78 formed therein that receives the fireplace unit 12. In the illustrated embodiment, the direct vent chimney 40 is shaped and sized to extend through or within the wall 76 so as to communicate with outside air. The receptacle 78 is positioned well above the floor 80 and is positioned at a location remote from and not surrounded by a conventional mantle of a fireplace. In one embodiment, the receptacle 78 and the fireplace unit 12 are positioned so that the middle of the firebox is roughly at eye level for an average adult standing up.

In the illustrated embodiment, the outer housing 50 of the fireplace unit 12 and the glass 66 are generally flush with the wall 76, and the frame 70 is mounted against the wall, thereby providing the decorative frame around the glass 66 and firebox 52, respectively. The glass 66 can be transparent or it can be a one-way mirror, as discussed above. When the glass 66 is a one-way mirror, the frame 70 can have an appearance of being a decorative mirror frame.

The above description of illustrated embodiments of the invention is not intended to be exhaustive or to limit the invention to the precise form disclosed. While specific embodiments of, and examples for, the invention are described herein for illustrative purposes, various equivalent modifications are possible within the scope of the invention, as those skilled in the relevant art will recognize. The teachings of the invention provided herein can be applied to other direct vent fireplace installations, not necessarily the particular installations described above.

While certain aspects of the invention are presented below in certain claim forms, the inventor contemplates the various aspects of the invention in any number of claim forms. In general, in the following claims, the terms used should not be construed to limit the invention to the specific embodiments disclosed in the specification and claims, but should be construed to include all components and methods of manufacturing the components in accordance with the claims. Accordingly, the invention is not limited by the disclosure, but instead the scope of the invention is to be determined entirely by the claims.

From the foregoing, it will be appreciated that specific embodiments of the invention have been described herein for purposes of illustration, but that various modifications may be made without deviating from the spirit and scope of the invention. Accordingly, the invention is not limited except as by the appended claims.

I claim:

1. A fireplace installation assembly connectable to a gas source, comprising:

a furniture unit comprising a decorative front facing portion having an upper half and a lower half, the upper half having an enlarged receptacle therein, the receptacle having first height and width dimensions, the first height dimension being greater than the first width dimension, and the lower half adapted to engage a support surface; and a gas-burning direct vent fireplace unit positioned in the enlarged receptacle in the upper half of the furniture unit, the fireplace unit having second height and width dimensions, the second height dimension being greater than the second width dimension, the fireplace unit having an outer housing, a firebox contained in the outer housing and having a portion at approximately eye-level of a standing average adult, a burner assembly in the firebox, a gas inlet connected to the burner assembly and connectable to a gas line, and a chimney coupled to the firebox, wherein the firebox of the fireplace unit is defined by a plurality of interconnected walls, and the fireplace unit further includes a firebox surround in the firebox and spaced apart from the interconnected walls.

2. The assembly of claim 1 wherein the furniture unit includes a substantially horizontal support portion connected to the front facing portion adjacent to the receptacle, the fireplace unit being supported on the support portion.

3. The assembly of claim 1 wherein the upper and lower halves of the furniture unit are integrally connected to each other.

4. The assembly of claim 1 wherein the furniture unit is a tall self-supporting unit positionable on the ground in a standing configuration.

5. The assembly of claim 1 wherein the lower half of the furniture unit is a display area.

6. The assembly of claim 1 wherein the lower half of the furniture unit includes shelves.

7. The assembly of claim 1 wherein the furniture unit is one of a book case, an entertainment center, an armoire, a cabinet, a hutch, a dresser, and a storage area.

8. The assembly of claim 1 wherein the fireplace unit is fully surrounded by the upper half of the furniture unit.

9. The assembly of claim 1 wherein the fireplace unit includes the surround in the firebox adjacent to the burner assembly, the surround defining a heat shield away from the firebox.

10. The assembly of claim 9 wherein the surround includes a decorative inner surface in the firebox and partially surrounding the burner assembly, the decorative inner surface being visible from a position exterior of the furniture unit.

11. The assembly of claim 1 wherein the upper half of the front facing portion includes a false front having no sidewalls or top panel.

12. The assembly of claim 1, further comprising a control unit coupled to the burner assembly.

13. The assembly of claim 1 wherein the upper half of the furniture unit includes a chimney passageway and the chimney extends through the chimney passage.

14. The assembly of claim 1 wherein the upper portion of the furniture unit includes a gas passageway and the gas inlet extend through the gas passageway.

15. A fireplace installation assembly connectable to a gas source, comprising:

a furniture unit comprising a decorative front facing portion having an upper half and a lower half, the upper half having an enlarged receptacle therein, the receptacle having first height and width dimensions, the first height dimension being greater than the first width dimension, and the lower half adapted to engage a support surface; and a gas-burning direct vent fireplace unit positioned in the enlarged receptacle in the upper half of the furniture unit, the fireplace unit having second height and width dimensions, the second height dimension being greater than the second width dimension, the fireplace unit having an outer housing, a firebox contained in the outer housing and having a portion at approximately eye-level of a standing average adult, a burner assembly in the firebox, a gas inlet connected to the burner assembly and connectable to a gas line, and a chimney coupled to the firebox, wherein the firebox of the fireplace unit has an interior volume of a first shape, and the fireplace unit further includes a surround contained in the firebox and shaped to define a second volume that has a second shape different from the first shape.

16. A fireplace installation assembly connectable to a gas source, comprising:

a furniture unit comprising a decorative front facing portion having an upper half and a lower half, the upper half having an enlarged receptacle therein, the receptacle having first height and width dimensions, the first height dimension being greater than the first width dimension, and the lower half adapted to engage a support surface; and a gas-burning direct vent fireplace unit positioned in the enlarged receptacle in the upper half of the furniture unit, the fireplace unit having second height and width dimensions, the second height dimension being greater than the second width dimension, the fireplace unit having an outer housing, a firebox contained in the outer housing and having a portion at approximately eye-level of a standing average adult, a burner assembly in the firebox, a gas inlet connected to the burner assembly and connectable to a gas line, and a chimney coupled to the firebox, wherein the fireplace unit includes a self-supporting, contoured surround removably placed in the firebox adjacent to the burner assembly and spaced apart from the firebox.

17. A fireplace installation assembly connectable to a gas source, comprising:

a furniture unit comprising a decorative front facing portion having an upper half and a lower half, the upper half having an enlarged receptacle therein, the receptacle having first height and width dimensions, the first height dimension being greater than the first width dimension, and the lower half adapted to engage a support surface; and a gas-burning direct vent fireplace unit positioned in the enlarged receptacle in the upper half of the furniture unit, the fireplace unit having second height and width dimensions, the second height dimension being greater than the second width dimension, the fireplace unit having an outer housing, a firebox contained in the outer housing and having a portion at approximately eye-level of a standing average adult, a burner assembly in the firebox, a gas inlet connected to the burner assembly and connectable to a gas line, and a chimney coupled to the firebox, wherein the fireplace unit includes a semi-dome shaped surround forming a heat shield to initially direct heat from the burner assembly forwardly away from the back of the firebox.

18. A fireplace installation assembly connectable to a gas source, comprising:

a furniture unit comprising a lower cabinet portion and an upper front face portion extending from the lower cabinet portion, the upper front face portion having an enlarged receptacle therein; and a gas-burning direct vent fireplace unit positioned in the enlarged receptacle in the upper front face portion of the furniture unit, the fireplace unit having an outer housing supported by lower cabinet portion, a firebox contained in the outer housing and having an opening in a front portion of the firebox, a burner assembly in the firebox, a gas inlet connected to the burner assembly and connectable to a gas line, a chimney coupled to the firebox, and a surround in the firebox adjacent to the burner assembly, the surround defining a heat shield that directs heat forwardly toward the opening in the front portion of the fire box.

19. The assembly of claim 18 wherein the furniture unit is a corner-mounted unit shaped and sized to fit into a corner of a room.

20. The assembly of claim 18 wherein the upper front face portion is integrally connected to the lower cabinet portion.

21. The assembly of claim 18 wherein the firebox of the fireplace unit has an interior volume of a first shape, and the surround is shaped to define a second volume that has a second shape different from the first shape.

22. The assembly of claim 18 wherein the surround includes a decorative inner surface in the firebox and partially surrounding the burner assembly, the decorative inner surface being visible from a position exterior of the furniture unit.

23. The assembly of claim 18 wherein the surround is a self-supporting, contoured surround removably placed in the firebox adjacent to the burner assembly and spaced apart from the firebox.

24. The assembly of claim 18 wherein the surround is a semi-dome shaped surround forming the heat shield that directs heat away from the back of the firebox.

25. A fireplace installation assembly connectable to a gas source, comprising:

a furniture unit having an enlarged receptacle therein; and a direct vent fireplace unit positioned in the enlarged receptacle in the furniture unit, the fireplace unit having an outer housing, a firebox contained in the outer housing, a burner assembly in the firebox coupleable to the gas source, a self supporting, contoured surround in the firebox and spaced apart from walls that define the firebox, and a chimney passageway coupled to the firebox, and the surround is positioned between the burner assembly and the firebox to isolate the firebox from flames generated at the burner assembly.

26. The assembly of claim 25 wherein the fireplace unit is fully surrounded by an upper portion of the furniture unit.

27. The assembly of claim 25 wherein the fireplace unit has a decorative front face with height and width dimensions, the height dimension being greater than the width dimension.

28. The assembly of claim 25 wherein the firebox has an interior volume of a first shape, and the surround defines a second volume having a second shape different from the first shape.

29. The assembly of claim 25 wherein the surround includes a decorative inner surface in the firebox and partially surrounding the burner assembly, the decorative inner surface being visible from a position exterior of the furniture unit.

30. The assembly of claim 25 wherein the furniture unit includes a chimney passageway and the chimney extends through the chimney passage.

31. The assembly of claim 25 wherein the furniture unit includes a gas passageway and the gas inlet extend through the gas passageway.

32. The assembly of claim 25 wherein the firebox has a back wall and sidewalls, and the surround blocks the back wall and sidewalls from being visible from an exterior position in front of the furniture unit.

33. A wall-mounted fireplace installation connectable to a gas source, comprising:

a wall structure having an enlarged receptacle positioned above the ground, the receptacle being remote from and not surrounded by a fireplace mantle; and a direct vent fireplace unit positioned in the enlarged receptacle in the wall structure, the fireplace unit having an outer housing, a firebox contained in the outer housing, a burner assembly in the firebox and coupleable to the gas source, a contoured surround in the firebox and extending around the burner assembly, the surround being spaced apart from the firebox to define a heat shield around the burner assembly, and an exhaust flue extending into a portion of the wall structure.

34. The installation of claim 33 wherein the receptacle in the wall structure and the fireplace unit is positioned with a middle portion at approximately eye level of an average adult person when standing.

35. The installation of claim 33 wherein the surround is freestanding and movable within the firebox.

36. A direct vent fireplace unit positionable in an enlarged receptacle above the ground in a furniture unit or a wall structure, the fireplace unit having an outer housing, a firebox contained in the outer housing and having a front and rear portion, a burner assembly in the firebox and coupleable to the gas source, a contoured surround positioned in the firebox at least partially around the burner assembly, the surround being spaced apart from the rear portion of the firebox to define a heat shield around the burner assembly that directs heat toward the front portion of the firebox, an exhaust flue coupled to the outer housing and connectable to a chimney, and a decorative front face coupled to the outer housing, the front face having height and width dimensions, the height dimension being greater than the width dimension.

37. The fireplace unit of claim 36 wherein the surround is a contoured surround having a shape different from an interior shape of the firebox.

38. The fireplace unit of claim 36 wherein the surround is freestanding within the firebox.

39. The fireplace unit of claim 28 wherein the surround is a self-supporting surround having a semi-dome shape.

* * * * *